US005207788A

United States Patent [19]

Geib et al.

[11] Patent Number: 5,207,788

[45] Date of Patent: May 4, 1993

[54] FEED ARRANGEMENT FOR CURRENCY HANDLING MACHINES

[75] Inventors: Joseph J. Geib, DesPlaines; Lars Stromme, Arlington Heights, both of Ill.

[73] Assignee: Cummins-Allison Corp., Mt. Prospect, Ill.

[21] Appl. No.: 928,535

[22] Filed: Aug. 13, 1992

Related U.S. Application Data

[63] Continuation of Ser. No. 680,585, Apr. 4, 1991, abandoned.

[51] Int. Cl.[5] ..... B65H 3/06

[52] U.S. Cl. ..... 271/122; 271/125

[58] Field of Search ..... 271/122, 124, 125

[56] References Cited

U.S. PATENT DOCUMENTS

| | | | |
|---|---|---|---|
| 2,214,752 | 9/1940 | Pierce | 271/122 X |
| 3,044,770 | 7/1962 | Breuers | 271/122 |
| 4,709,911 | 12/1987 | Saiki | 271/122 X |
| 4,715,597 | 12/1987 | Sakurai | 271/122 |
| 4,861,013 | 8/1989 | Shibata | 271/122 X |
| 4,869,490 | 9/1989 | Reid | 271/122 |

FOREIGN PATENT DOCUMENTS

| | | | |
|---|---|---|---|
| 119640 | 9/1980 | Japan | 271/122 |

*Primary Examiner*—Richard A. Schacher
*Attorney, Agent, or Firm*—Arnold White & Durkee

[57] ABSTRACT

An improved feed arrangement is provided for use with currency handling apparatus in which cooperating action of an actively-driven drum roller is used for feeding bills stacked in an input bin along the bill transport path. The picker roller is rotationally driven, not by direct contact with the drum roller, but by contact with a pressure roller which is driven by the drum roll. In effect, the picker roller is rotated in a direction counter to the direction of the bill flow so that bills other than the bottom bill in a given stack are effectively pushed away from the direction of bill flow. The picker roller is, consequently, activated to function as a retard roller, as opposed to the conventional feeding action provided by picker rollers which are in counter-rotating contact with the drum roller about the direction of bill flow.

11 Claims, 5 Drawing Sheets

FEED ARRANGEMENT FOR CURRENCY HANDLING MACHINES

This is a continuation of copending application Ser. No. 07/680,585 filed on Apr. 4, 1991 now abandoned.

BACKGROUND OF THE INVENTION

2. Field of the Invention

The present invention generally relates to paper or currency handling machines. The invention relates more particularly to a method and apparatus for efficient feeding of stacked currency bills and the like in single file, from a hopper to a downstream stacker along a system transport path, with reduced possibility of double feeding and chaining errors.

2. Description of the Related Art

Numerous techniques and apparatus have been developed and are commercially available for addressing a wide range of automated currency handling applications. Advanced systems of this type are capable of identifying and discriminating between and automatically counting multiple currency denominations, and typically employ some form of optical sensing for discriminating between different currency denominations.

In such currency handling apparatus, currency bills to be discriminated according to denomination and counted are accepted within an input bin or hopper defined by a plurality of enclosing vertically disposed walls in combination with a generally sloping bottom surface, so that the enclosure is adapted to support a stack of currency bills positioned therein. From the input bin, currency bills are moved along a multi-sectional transport path through a currency discrimination station where test bills are identified according to denomination and counted before being relayed to a stacker where processed bills are stacked for subsequent removal.

An exemplary currency discrimination and counting apparatus of this type is described in detail in Raterman, et al. U.S. patent application Ser. No. 07/475,111, filed Feb. 5, 1990, entitled Method and Apparatus For Currency Discrimination and Counting, assigned to Cummins-Allison Corporation, which is also the Assignee of all patent rights related to the present application. The disclosure in that application is incorporated herein by reference for purposes of facilitating the understanding of the mechanical arrangement according to which currency bills stacked in the input bin are moved along a multi-sectional transport path.

Such a bill transport path typically includes an input path where bills are moved along a fast direction in a substantially flat position, a curved guideway where bills are accepted from the input path and guided in such a way as to change the direction of travel to a second different direction, and an output path where the bills are moved in a flat position along the second different direction across currency discrimination means located downstream of the curved guideway.

In the currency handling and counting apparatus described in the above-identified Raterman, et al. application, as well as in other apparatus of this type, it is important to provide means for picking up or "stripping" currency bills, one at a time, from bills that are stacked in the input bin of the apparatus. Toward realizing this "stripping" action, at least one rotationally driven feed roller is provided within the input bin area in the form of an eccentric roller at least a part of the periphery of which is provided with a relatively high friction-bearing surface. In operation, the friction-bearing surface on the feed roller engages the bottom bill of a stack of bills in the input bin as the roller rotates; this initiates the advancement of the bottom bill along the transport path, and the eccentric surface of the feed roller essentially "jogs" the bill stack once per revolution so as to agitate and loosen the bottom currency bill within the stack, thereby facilitating the advancement of the bottom bill along the feed direction.

Typically, the feed roller action is supplemented by one or more drum or capstan rollers disposed downstream of the feed roller and which also is rotationally driven and includes a periphery having a friction-bearing surface. Rotational movement of the drum roller induces additional frictional contact with bills which have presumably already been "jogged" by the earlier action of the feed roller.

With arrangements of this type, active contact between the drum rollers and a currency bill which is jogged by the feed roller and is in the process of being advanced frictionally by the drum rollers is insured by the provision of at least one picker roller for exerting a consistent downward force onto the leading edges of the currency bills stationed within the input bill. The picker rollers are pivotally mounted in a freewheeling fashion and, in the absence of currency bills in contact with the drum roller, bear down upon the drum roller and, accordingly, are induced into counter-rotation therewith.

When currency bills are present and are in contact with the drum roller, the picker rollers bear down into contact with the leading edges of the currency bills and exert a direct downward force on the bills since the rotational movement of rollers is inhibited. When a substantially large stack of bills is present, the result is that the advancing action brought about by the rotational movement of the drum roller is accentuated, thereby facilitating the stripping away of a single currency bill at a time from the bill stack.

While the above-described feed arrangement functions effectively with large stacks of bills, the feeding action of the picker rollers tends to inhibit the "stripping" action when a relatively small stack of bills, typically about 20 to 30 bills, is fed from the hopper. The problem is particularly severe when new or "brick" currency, which strongly tends to stick together, is being handled. Under these conditions, the contact between the picker rollers and the drum rollers generates counter-rotating contact of the picker rollers which, in turn, tends to pull the top bills in the small stack into the nip formed between the picker and drum rollers. When the bill stack is particularly small and comprises "brick" currency, the separation between the bottom and top bills is relatively small and, accordingly, the top bills are also likely to be fed in, at least partially, along with the bottom bill. The end result is a substantially high likelihood of double document and bill chaining errors.

There, accordingly, exists a distinct need in present currency feeding arrangement of the above-noted type for means for improving the "stripping" action necessary for ensuring single feeding of bills, particularly for "brick" currency, being fed from a relatively small bill stack.

SUMMARY OF THE INVENTION

It is a principal object of the present invention to provide an improved feed arrangement for "stripping" and feeding paper documents such as currency bills from a stacker in a paper handling machine such as a currency recognition and counting machine.

It is an object of the present invention to provide an improved feed arrangement of the above kind which is capable of efficiently stripping and feeding bills in single file from a bill stacker while substantially reducing the possibility of double-feed or chaining errors.

An associated object of this invention is to provide an improved feed arrangement of the above type which is particularly adapted for efficient bill stripping action when used with relatively small stacks of new or "brick" currency.

A related object of this invention is to provide such an improved feed arrangement which is simple, economical, and has uncomplicated construction and operation.

It is a specific object of the present invention to provide such an improved feed arrangement which is conveniently adapted for use with minor modifications to conventional currency feed arrangements.

Briefly, in accordance with the present invention, the objectives enumerated above are achieved by means of an improved feed arrangement which is particularly adapted for use with currency identification and counting apparatus in which cooperating action of an actively-driven drum roller and a corresponding passively-driven picker roller is used for feeding bills stacked in a system hopper along the bill transport path. According to an important feature of the present invention, the feeding arrangement is such that the picker roll is rotationally driven in a direction counter to the direction of bill flow so that bills other than the bottom bill in a given stack are effectively pushed away from bill flow. In essence, the picker roller is activated in such a fashion as to function as a "retard" roller, as opposed to the conventional "feeding" action provided by picker rollers which are subjected to counter-rotating contact with the drum roller along the direction of bill flow.

According to a feature of the present invention, the improved feed arrangement advantageously uses the rotational action of a pressure roller which is typically used in currency handling systems for counter-rotating contact with the drum roller in order to accelerate bills which are fed along the transport path by the cooperating action of the picker and drum rollers. More specifically, the arrangement is such that the picker roller is passively driven, not by contact with the drum roller along the direction of bill flow but, instead, by counter-rotating contact with the pressure roller so as to rotate along a direction counter to that of the bill flow. According to an illustrative embodiment, the action of the conventional drum roller is implemented by the use of a pair of axially spaced drum rollers and the picker roller is mounted in a pivotal fashion so as to normally be in counter-rotating contact with the pressure roller. A pair of stationary separator rollers are loaded into contact with the corresponding drum rollers and are adapted to exert a predefined downwardly-bearing force upon bills that come between the separator and drum rollers.

In operation, when the currency handling machine runs idly, i.e., without any bills being processed, the picker roller pivots down into contact with the pressure roller. The drum roller actively rotates the pressure roller about the direction of bill flow and, accordingly, the picker roller is rotated by contact with the pressure roller in a direction counter to that of bill flow. Under these circumstances, when a small stack of bills is processed through the feed arrangement, the rotational movement of the drum roller jogs the bottom bill away from the bill stack and feeds it in along the transport path. If, at the same time, one or more of the upper bills are also pulled in together with the bottom bill, the rotation of the picker roll counter to the direction of bill flow acts as a retarding action preventing such upper bills, particularly the top-most bill, from being fed in along with the bottom bill.

Once the bottom bill does get fed in between the drum and picker rollers, the presence of this bill pivots the picker roller upwardly out of contact with the pressure roller. Accordingly, at that point in time, the counter rotation of the picker roller stops and the roller remains relatively neutral. The critical aspect, however, is that the initial counter rotation of the picker roller allows it to function as a retard roller and prevents any additional bills from being fed in along with the bottom bill, even when the bill stack is relatively small.

According to a preferred embodiment, the outer periphery of the picker roller is provided with a material having a relatively low co-efficient of friction so as to control the retarding action affected upon bills. According to a further feature of the present invention, provision is made for selectively operating the picker roller in accordance with the above-described retard motion only when bill feeding is desired, while operating the picker roller as a conventional feeder roll at other times. More specifically, the arrangement is such that the picker roller, when in contact with the pressure roller, overlaps the periphery of the drum roller but freely pivots into and out of contact with the pressure roller by being positioned within a groove or release defined about the drum roller. By the selective provision of protruding contacts on the periphery of the drum roller, it can be ensured that the rotational action of the drum roller is imparted directly to the picker roll when the protrusions on the periphery of the drum roller contact the picker roller.

As a result, the counter rotating motion of the picker roller in a direction counter to that of bill flow is interrupted and, in fact, reversed when contact is established between the picker roller and the drum roller. In effect, the picker roller is rotated in a controlled rotation along the direction of feeding when documents are not being fed and rotated in a direction counter to that of bill flow when documents are in fact being fed. This arrangement is particularly advantageous in cases where increased retard action required for separating light brick currency is realized by the provision of a friction surface on the picker roll. Here, it may be necessary to have intermediate feeding action to ensure feeding in of all bills despite the retard action of the picker roll. Further control over the amount of retarding action realized by the rotational movement of the picker roller can be affected by the provision of indentations, cleats or like surfaces on the periphery of the picker roller.

DESCRIPTION OF THE PREFERRED EMBODIMENTS

Figure 1:
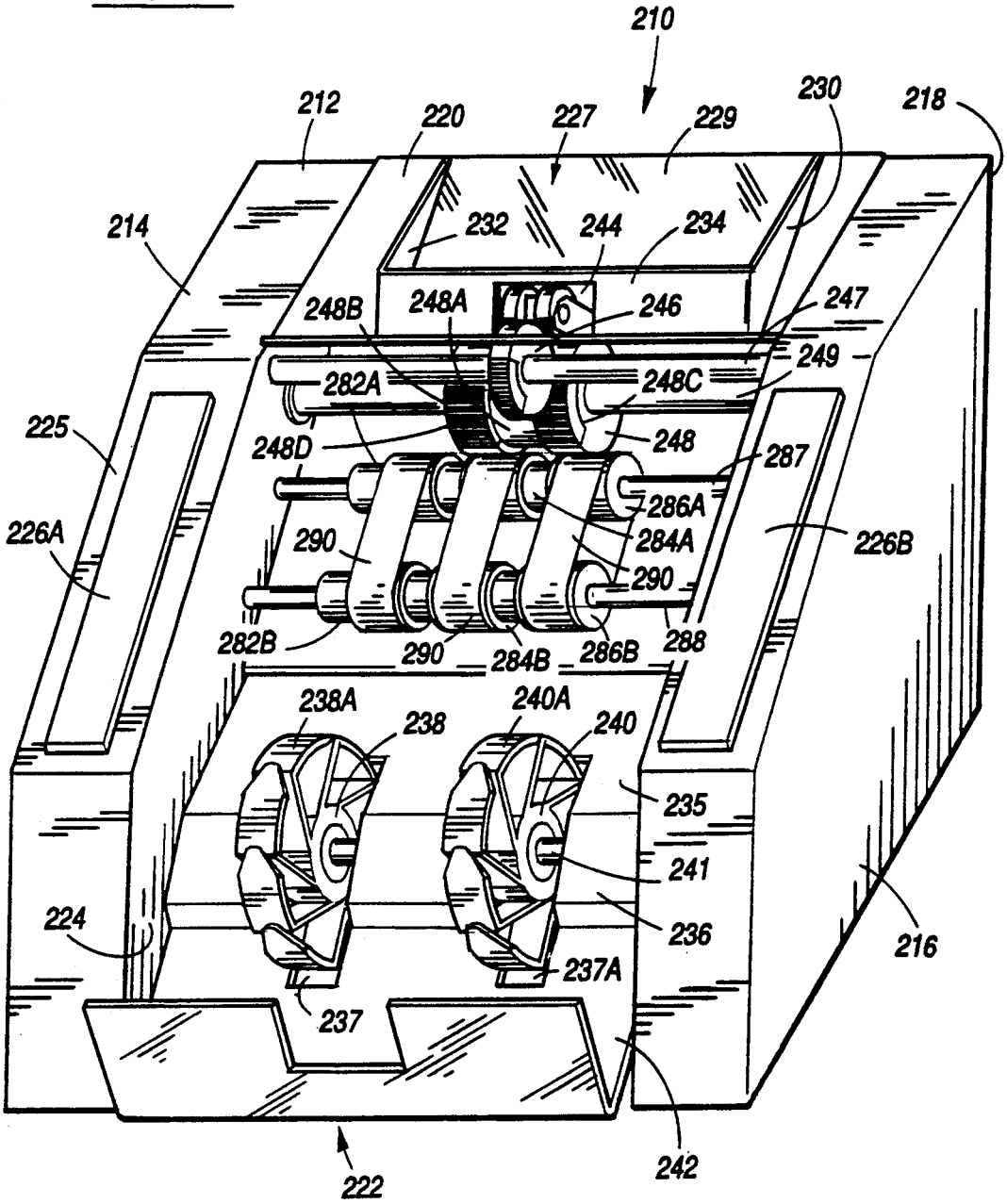
FIG. 1 is a perspective view showing currency discrimination and counting apparatus of the general type in which the improved feeding arrangement of the present invention may be advantageously used.

As noted above, the novel feed arrangement described herein is adapted for the efficient stripping and feeding of various types of stacked documents. The arrangement is particularly advantageous for use with currency handling machines of the type described in detail in the previously noted Raterman, et al. patent application. For ease of understanding, the general mechanical structure of the currency handling apparatus shown in that application, as well as the associated feed arrangement, is briefly described below in connection with FIGS. 1 & 2. These drawings show currency handling apparatus 210 which essentially, comprises a housing 212 which includes left and right sidewalls 214 and 216, respectively, a rear wall 218, and a top surface generally designated as 220. The apparatus has a front section 222 which comprises a generally vertical forward section 224 and a forward sloping section 225 which includes side sections provided with control panels 226A and 226B upon which various control switches for operating the apparatus, as well as associated display means, are mounted.

For accepting a stack of currency bills 228 which have to be discriminated according to denomination, an input bin 227 is defined on the top surface 220 by a downwardly sloping support surface 229 on which are provided a pair of vertically disposed side walls 230, 232 linked together by a vertically disposed front wall 234. The walls 230, 232 and 234, in combination with the sloping surface 229, define an enclosure where the stack of currency bills 228 is positioned.

From the input bin, currency bills are moved along a multi-sectional transport path which includes an input path where bills are moved along a first direction in a substantially flat position, a curved guideway where bills are accepted from the input path and guided in such a way as to change the direction of travel to a second different direction, and an output path where the bills are moved in a flat position along the second different direction across currency discrimination means (not shown) located downstream of the curved guideway, as will be described in detail below. Preferably, the transport path is defined in such a way that currency bills are accepted from the input bin, transported along the input path, the curved guideway, and the output path, and stacked with the narrow dimension "W" of the bills being maintained parallel to the transport path and the direction of movement at all times.

The forward sloping section 225 of the document handling apparatus 210 includes a platform surface 235 centrally disposed between the side walls 214, 216 and is adapted to accept currency bills which have been processed through appropriate currency discrimination means for being delivered to a stacker plate 242 where the processed bills are stacked for subsequent removal. More specifically, the platform 235 includes an associated angular surface 236 and is provided with openings 237, 237A from which flexible blades 238A, 240A of a corresponding pair of stacker wheels 238, 240, respectively, extend outwardly. The stacker wheels are supported for rotational movement about a stacker shaft 241 disposed about the angular surface 236 and suspended across the side walls 214 and 216.

The flexible blades 238A, 240A of the stacker wheels cooperate with the stacker platform 235 and the openings 237, 237A to pick up currency bills delivered thereto. The blades operate to subsequently deliver such bills to a stacker plate 242 which is linked to the angular surface 236 and which also accommodates the stacker wheel openings and the wheels projecting therefrom. During operation, a currency bill which is delivered to the stacker platform 235 is picked up by the flexible blades and becomes lodged between a pair of adjacent blades which, in combination, define a curved enclosure which decelerates a bill entering therein and serves as a means for supporting and transferring the bill from the stacker platform 235 onto the stacker plate 242 as the stacker wheels rotate. The mechanical configuration of the stacker wheels and the flexible blades provided thereupon, as well as the manner in which they cooperate with the stacker platform and the stacker plate, is conventional and, accordingly, is not described in detail herein.

The bill handling and counting apparatus 210 is provided with means for picking up or "stripping" currency bills, one at a time, from bills that are stacked in the input bin 227. This type of feed arrangement, as described below, is representative of the existing state-of-the-art in stripping and feeding bills in commercially available currency handling machines. In order to provide the stripping action, a feed roller 246 is rotationally suspended about a drive shaft 247 which, in turn, is supported across the side walls 214, 216. The feed roller 246 projects through a slot provided on the downwardly sloping surface 229 of the input bin 227 which defines the input path and is in the form of an eccentric roller at least a part of the periphery of which is provided with a relatively high friction-bearing surface 246A. The surface 246A is adapted to engage the bottom bill of the bill stack 228 as the roller 246 rotates; this initiates the advancement of the bottom bill along the feed direction represented by the arrow 247B (see FIG. 13). The eccentric surface of the feed roller 246 essentially "jogs" the bill stack once per revolution so as to agitate and loosen the bottom currency bill within the stack, thereby facilitating the advancement of the bottom bill along the feed direction.

The action of the feed roller 246 is supplemented by the provision of a capstan or drum 248 which is suspended for rotational movement about a capstan drive shaft 249 which, in turn, is supported across the side walls 214 and 216. Preferably, the capstan 248 comprises a centrally disposed friction roller 248A having a smooth surface and formed of a friction-bearing material such as rubber or hard plastic. The friction roller is sandwiched between a pair of capstan rollers 248B and 248C at least a part of the external periphery of which are provided with a high friction-bearing surface 248D.

The friction surface 248D is akin to the friction surface 246A provided on the feed roller and permits the capstan rollers to frictionally advance the bottom bill along the feed direction. Preferably, the rotational movement of the capstan 248 and the feed roller 246 is synchronized in such a way that the frictional surfaces provided on the peripheries of the capstan and the feed roller rotate in unison, thereby inducing complimentary frictional contact with the bottom bill of the bill stack 228

Figure 2:
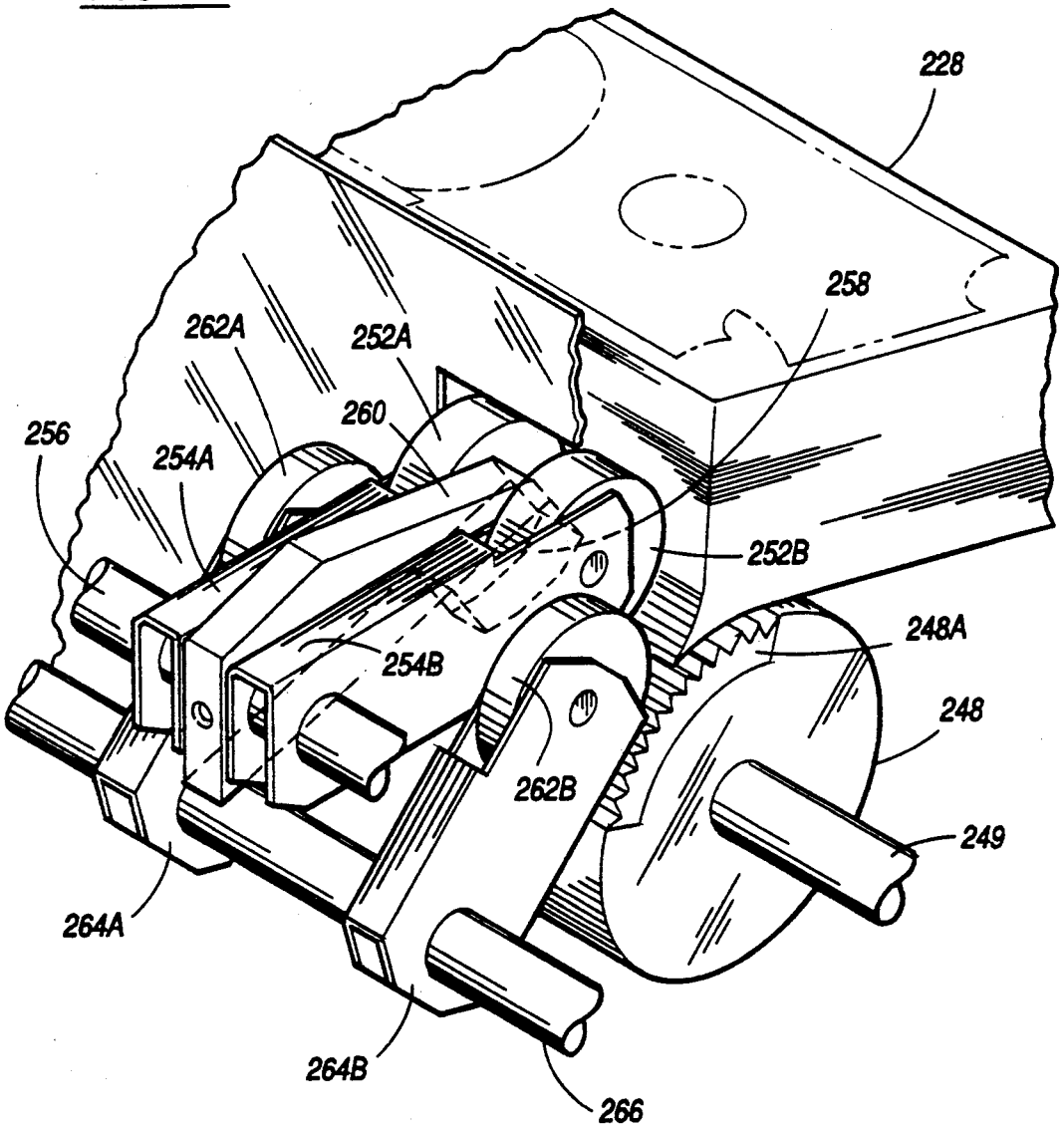
FIG. 2 is a partial perspective view illustrating a feed arrangement used for separating currency bills in currency handling apparatus of the type shown in FIG. 1.

In currency handling machines of the type disclosed in FIGS. 1 & 2, active contact between the capstan 248 and a currency bill which is jogged by the feed roller 246 and is in the process of being advanced frictionally by the capstan rollers 248B, 248C, is ensured by the provision of a pair of picker rollers 252A, 252B for exerting a consistent downward force onto the leading edges of the currency bills stationed in the input bin 227. The picker rollers are supported on corresponding picker arms 254A, 254B which, in turn, are supported for arcuate movement about a support shaft 256 suspended across the side walls of the apparatus. The picker rollers are freewheeling about the picker arms and when there are no currency bills in contact with the capstan 248, bear down upon the friction roller 248A and, accordingly, are induced into counter-rotation therewith.

However, when currency bills are present and are in contact with the capstan 248, the picker rollers bear down into contact with the leading edges of the currency bills and exert a direct downward force on the bills since the rotational movement of rollers is inhibited. The result is that the advancing action brought about by contact between the friction-bearing surfaces 248D on the capstan rollers 248B, 248C is accentuated, thereby facilitating the stripping away of a single currency bill at a time from the bill stack 228.

In between the picker arms 254A, 254B, the support shaft 256 also supports a separator arm 260 which carries at its end remote from the shaft a stationary stripper shoe 258 which is provided with a frictional surface which imparts a frictional drag upon bills onto which the picker rollers bear down. The separator arm is mounted for arcuate movement about the support shaft 256 and is spring loaded in such a way as to bear down with a selected amount of force onto the capstan.

In operation, the picker rollers rotate with the rotational movement of the friction roller 248A due to their free wheeling nature until the leading edges of one or more currency bills are encountered. At that point, the rotational movement of the picker rollers stops and the leading edges of the bills are forced into positive contact with the friction bearing surfaces on the periphery of the capstan rollers. The effect is to force the bottom bill away from the rest of the bills along the direction of rotation of the capstan. At the same time, the separator shoe 258 also bears down on any of the bills that are propelled forward by the capstan rollers.

The tension on the picker arm 254A is selected to be such that the downward force exerted upon such a propelled bill allows only a single bill to move forward. If two or more bills happen to be propelled out of the contact established between the picker rollers and the capstan rollers, the downward force exerted by the spring-loaded shoe should be sufficient to inhibit further forward movement of the bills. The tension under which the picker arm is spring loaded can be conveniently adjusted to control the downward bearing force exerted by the shoe in such a way as to compliment the bill stripping action produced by the picker rollers and the capstan rollers. Thus, the possibility that more than two bills may be propelled forward at the same time due to the rotational movement of the capstan is significantly reduced.

The bill transport path includes a curved guideway (not shown in FIGS. 1 & 2) provided in front of the capstan 248 for accepting currency bills that have been propelled forward along the input path defined by the forward section of the sloping surface 229 into frictional contact with the rotating capstan. The guideway includes a curved section which corresponds substantially to the curved periphery of the capstan 248 so as to compliment the impetus provided by the capstan rollers 248B, 248C to a stripped currency bill.

A pair of idler or pressure rollers 262A, 262B is provided downstream of the picker rollers for guiding bills propelled by the capstan 248 along the transport path. These pressure rollers are disposed in direct counter-rotating contact with the capstan 248. More specifically, the pressure rollers are mounted on corresponding idler arms 264A, 264B which are mounted for arcuate movement about an idler shaft 266 which, in turn, is supported across the side walls of the apparatus. The idler arms are spring loaded on the idler shaft so that a selected downward force can be exerted through the idler rollers onto a stripped bill, thereby ensuring continued contact between the bill and the capstan 248 until the bill is guided into the curved guideway section along the bill transport path.

Downstream of the curved guideway section 272, the bill transport path has a output path for currency bills. The output path is provided in the form of a flat section along which bills which have been guided along the curved guideway by the pressure rollers 262A, 262B are moved along a direction which is opposite to the direction along which bills are moved out of the input bin. Thus, a currency bill which is stripped from the bill stack in the input bin is initially moved along the input path under positive contact between the picker rollers 252A, 252B and the capstan rollers 248B, 248C. Subsequently, the bill is guided through the curved guideway section under positive contact with the pressure rollers 262A, 262B onto the flat section of the output path.

The feed arrangement described above in detail in connection with FIGS. 1 & 2 operates effectively under most application conditions where relatively large stacks of bills are positioned in the input bin. Under these conditions, the combined action of the stationary stripper, the picker rollers and the drum rollers is sufficient to realize the requisite stripping of only the bottom bill from the bill stack. In particular, in combination with the downward-bearing force exerted by the stationary stripper, the counter-rotating contact between the picker rolls and the capstan rollers effectively strips the bottom bill away from the stack into the nip formed between the picker and drum rollers. In this type of arrangement, the drum rollers are rotated about the direction of bill flow (counter clockwise in FIG. 2) in order to advance bills along the transport path. Accordingly, the picker rollers, by virtue of their direct contact with the drum rollers, are also rotated along the direction of bill flow (clockwise in FIG. 2).

It has been determined in practice that the above type of feed arrangement is ineffective at stripping bills in single file fashion when used with relatively small stacks of bills (of the order of about 15 to 30 bills) particularly where the stacks comprise bills of new or "brick" currency wherein bills have a strong tendency to stick together. Under these conditions, it has been determined that the rotational movement of the picker rollers along the direction of bill flow (i.e., the clockwise direction in FIG. 2) actually tends to pull in the top bills of the small bill stack, at least partially, along with the bottom bill into the nip formed between the picker and drum rollers. As a result, when such small stacks of "brick" currency are handled using conventional feed arrangements, the likelihood of double-feeding or chaining errors is substantially high and can seriously degrade the operational efficiency of the machine.

The above-identified problems associated with feeding arrangements of the type described above are solved, in accordance with the system of the present invention, by means of a feed arrangement wherein a picker roller is initially subjected to rotational movement which is counter to the direction of bill flow so as to effectively function as a retard roller. As a result, the picker roller imposes a retarding action upon currency bills which come into contact therewith, as opposed to the conventional rotation of the picker roller along the direction of bill flow. More specifically, the feed arrangement is such that the picker roller is pivoted downwardly to such an extent as to initially contact, not the drum roller which rotates along the direction of bill flow, but a downstream pressure roller maintained in counter-rotating contact with the drum rollers. Consequently, the picker roller is driven, not by the actively-driven drum rollers, but, instead, by the passively-driven pressure roller.

Figure 3:
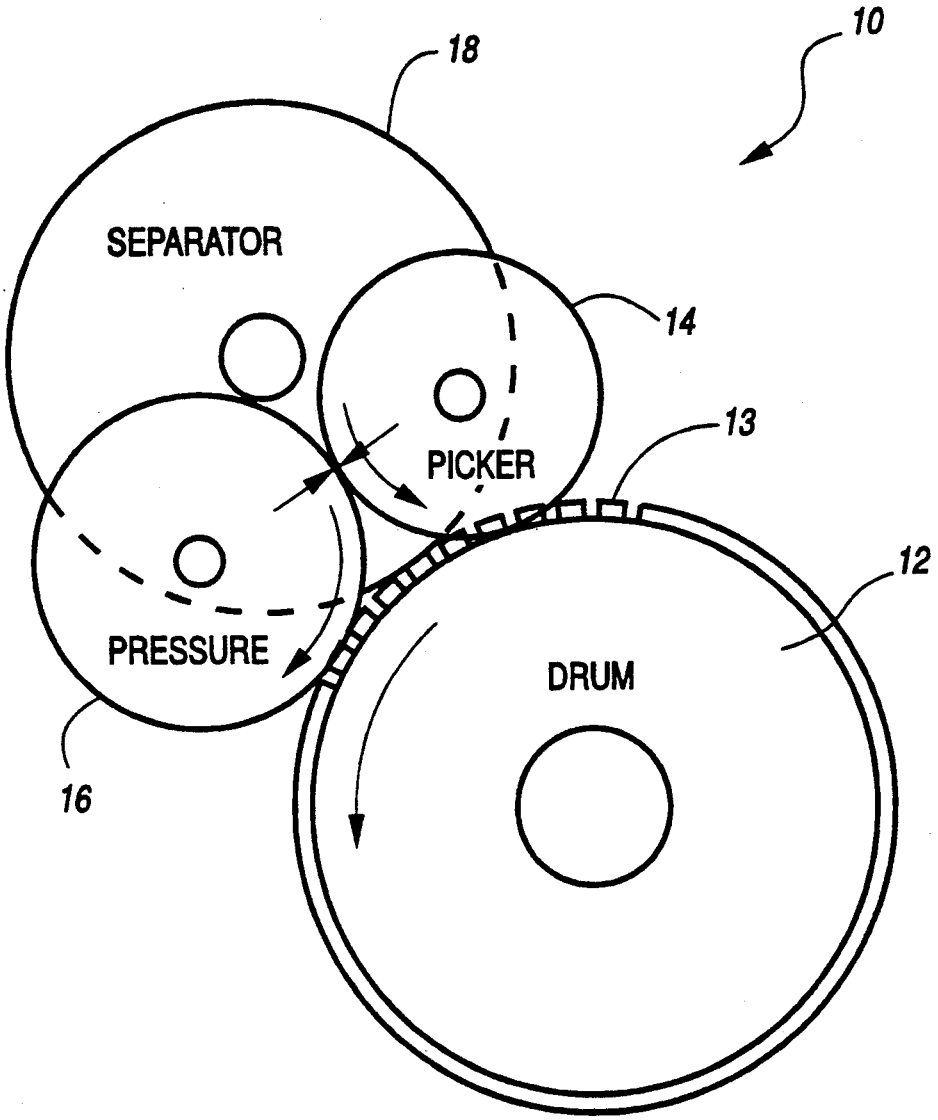
FIG. 3 is a simplified illustration of the novel feed arrangement for efficient separation of stacked bills, in accordance with the principles of the present invention.

Such an arrangement is illustrated in FIG. 3, which shows a partial side view of the drive rollers in accordance with a preferred embodiment of the present invention. The feed arrangement 10 shown in FIG. 3 includes a pair of drum rollers (only one is seen in the side view of FIG. 3) which is actively driven rotationally along the direction of bill flow (as indicated by the arrow). As shown in FIG. 3, the rotational movement of the drum roller 12 is in the counter clockwise direction. At least one picker roller 14 is pivotally mounted in such a manner as to be in direct counter-rotating contact with a pressure roller 16 which, in turn, is maintained constantly in direct contact with the rotating drum roller 12. As is conventional, the drum roller is provided with a high friction-bearing surface 13 on at least a part of the external periphery thereof. A pair of stationary separator rollers 18 (only one is seen in FIG. 3) are positioned so as to be constantly exerting a predetermined amount of force downwardly acting upon the drum roller 12; these separator rollers 18 essentially correspond to the separator/shoe arrangement described above.

The picker roller 14 is mounted in such a way as to be capable of pivotal motion, preferably under the gravitational action of its own weight, toward and away from the pressure roller 16. When the machine is running idly (as shown in FIG. 3), the picker roller 14 pivots down into free counter-rotating contact with the permanently positioned pressure roller 16. As specifically shown in the arrangement of FIG. 3, the periphery of the picker roller 14 overlaps the periphery of the drum roller 12; however, a corresponding groove or release (not shown) is provided on the drum roller so that the picker roller 14 may pivot therethrough without obstruction into and out of contact with the pressure roller 16.

Figure 4:
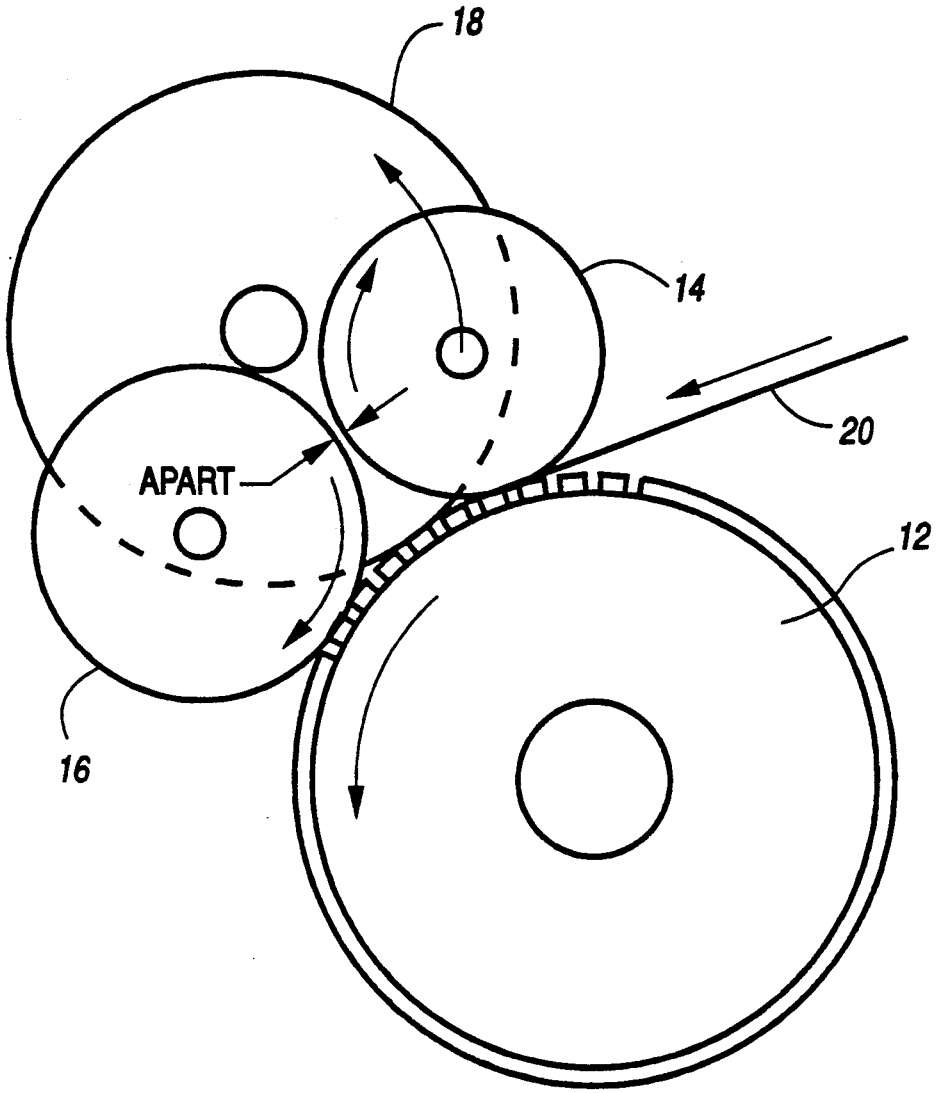
FIG. 4 is a illustration of the novel feed arrangement of this invention showing the relative disposition of the drive rollers when bills are processed therethrough.

Referring now to FIG. 4, there is illustrated the feed arrangement of FIG. 3 when the drum roller acts upon a stack of bills. As a stack of bills comes into contact with the picker roller 14, the counter-clockwise rotation of the picker roller 14 kicks back or retards the upper bills in the stack. At the same time, the counter-clockwise rotation of the drum roller pulls in the bottom-most bill 20 into the nip between the picker roller 14 and drum roller 12. At this point, since the picker roller 14 is mounted for free pivotal motion toward and away from the pressure roller 16, the presence of the bill 20 causes the pressure roller 14 to pivot out of contact with the pressure roller 16. Further, since the picker roller 14 is freewheeling, the positive rotational movement of the drum roller 12 along the direction of bill flow effectively draws the bill 20 along the transport path while rotating the picker roller 14 to the extent necessary in a clockwise direction.

Accordingly, once the bottom-most bill of a small bill stack does get fed in between the drum and picker rollers, the presence of the bill pivots the picker roller (which, as noted above, is suspended in an arcuately movable fashion relative to the pressure roller) upwardly out of contact with the pressure roller. At that point, the counter-rotation of the picker roller stops and the roller remains relatively neutral. This neutral position is maintained until about the time when the last bill in the stack is fed in under the action of the drum roller, whereupon the picker roller pivots back into counter-rotating contact with the pressure roller.

The crucial aspect of the above-described action is that the initial rotation of the picker roller 14 in a direction counter to that of bill flow effectively prevents bills other than the bottom-most bill 20 from being fed therewith by retarding or kicking these bills along a direction counter to that of bill flow. As subsequent bottom bills are fed in this fashion, the picker roller 14 is maintained relatively neutral and out of contact with the pressure roller 16. At the same time, the arcuate periphery of the picker roller remains in positive, yet neutral, contact with the incoming bills in the bill stack without exerting any direct "feeding" action thereupon that would tend to pull in one or more of the upper bills along with the bottom bill. The end result is that incoming bills are subjected to a "fanning" motion which effectively strips bottom bills successively away from the rest of the bill stack.

Preferably, the external surface of the periphery of the picker roller 14 is formed of a low-friction material such as smooth-surfaced steel, so that a relatively controlled amount of retard action is exerted upon incoming bills. It should, however, be noted that the external surface of the picker roller may be provided with a friction-bearing material so that the retard action exerted upon incoming bills may be further enhanced. In addition, the amount of retard action may also be controlled by the provision of indentations, cleats or like surfaces on the periphery of the picker roller so as to further supplement the retard action provided by the rotation of the roller against the direction of bill flow As a further feature of the present invention, the external surface on the periphery of the drum rollers 12 may be provided with selectively positioned indentations, cleats, or like eccentric surfaces so that intermittent contact ma be established between the picker roller 14 and the drum rollers 12, in such a manner as to selectively alternative the rotation of the picker roller by (i) counter-rotating contact with the pressure roller 16 in a direction against that of bill flow, and (ii) by direct counter-rotating contact with the drum roller 12 along the direction of bill flow.

As noted above, the picker roller is preferably positioned in such a way that its periphery overlaps the periphery of the drum roller; however, the picker roller is capable of unhindered pivotal motion into and out of contact with the pressure roller by being suspended within a groove or release defined about the drum roller periphery. With this arrangement, protruding eccentric surfaces (such as cleats, indentations, etc.) may be selectively disposed on the drum roller periphery so that the picker roller is intermittently brought into contact with the drum roller (when the protrusions contact the picker roller) and with the pressure roller (when there are no protrusions upon the drum roller and the picker roller pivots away from contact therewith).

As a result, the picker roller can be selectively operated as a retard roller (in contact with the pressure roller) when incoming "top" bills are to be retarded, and as a feed roller (in contact with the drum roller) when some feeding action is required upon the bills to supplement that provided by the drum roller itself. This intermittent contact arrangement is particularly advantageous where the picker roller is provided with an external friction surface for imparting increased retard action upon documents, such as light brick currency, which have a very strong tendency to stick together. In such cases, intermediate feeding action may be necessary to ensure that all bills in the stack (particularly the last few bills) are in fact fed in despite the strong retard action of the picker roller which could otherwise retard or kick back such bills and prevent them from being fed in only under the action of the drum roller.

Figure 5:
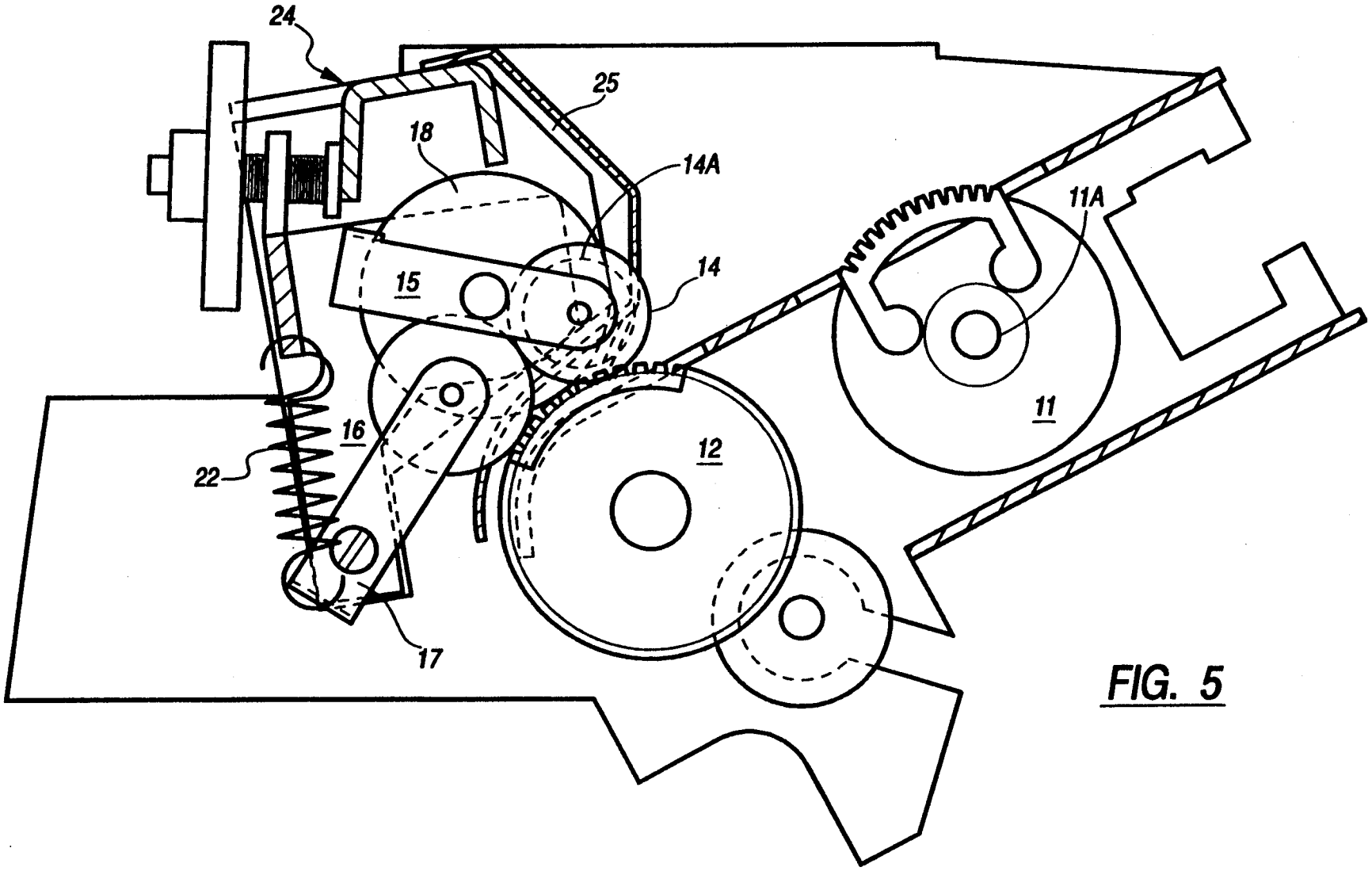
FIG. 5 is a detailed side view of an illustrative structural implementation of the improved feed arrangement according to the present invention.

Referring now to FIG. 5, there is shown a detailed side view of an illustrative mechanical implementation of the feed arrangement described above in connection with FIGS. 3 & 4. Again, for purposes of clarity and ease of understanding, only components essential to the present novel feed arrangement are described. The feed arrangement includes a feed roller 11 which is rotationally suspended within the input bin area about a drive shaft 11A, which, in turn, is supported between the side walls of the machine (not shown). The feed roller 11 projects through a slot provided on the downwardly sloping surface of the input bin and is similar to the arrangement described above in connection with FIGS. 1 & 2.

In particular, the feed roller 11 is in the form of an eccentric roller, at least a part of the periphery of which is provided with a relatively high friction-bearing surface 11B. The surface 11B is adapted to engage the bottom bill of a bill stack as the roller 11 rotates; this initiates the advancement of the bottom bill along the feed direction represented by the arrow. The eccentric surface 11B of the feed roller 11 "jogs" the bill stack once per revolution so as to agitate and loosen the bottom currency bill within the stack, thereby facilitating the advancement of the bottom bill along the feed direction.

The feed action of the feed roller 11 is supplemented by a capstan or drum roller 12 which is suspended for rotational movement about a drive shaft 12A which, in turn, is supported across the side walls of the machine (not shown). Preferably, the capstan or drum roller 12 can itself be provided in the form of a centrally disposed friction roller having a smooth surface formed from a friction-bearing material flanked by a pair of capstan rollers, at least a part of the external periphery of which is provided with a high friction-bearing surface; such an arrangement corresponds to the type described in connection with FIGS. 1 & 2. In FIG. 5, the partial friction-bearing surface on the drum roller 12 is represented by 13 (as in FIGS. 3 & 4). This surface is similar to the friction surface 11B on the feed roller 11 and permits the drum rollers to frictionally advance the bottom bill along the feed direction. Preferably, the rotational movement of the drum and feed rollers is synchronized so that the frictional surfaces provided thereupon rotate in unison, thereby inducing complementary frictional contact with the bottom bill in a bill stack.

A pair of free-wheeling picker rollers 14 of the type described above are axially disposed in a spaced-apart manner on a support shaft 14A and suspended in the above-noted pivotal manner by means of a pair of support arms 15 which are capable of swinging or pivoting the rollers 14 in an arcuate fashion into and out of contact with a pressure roller 16.

The pressure roller 16 itself is suspended in a spring-loaded manner through corresponding support arms 17 so as to be in direct contact with the drum rollers 12 under a selected amount of pressure exerted by a spring 22 which is suitably suspended from the housing which encloses the overall feed arrangement. A pair of separator rollers 18 (one of which is visible in the side view of FIG. 5) is suspended within the machine housing in such a manner as to bear down upon the drum rollers 12 with a controllable amount of downwardly acting force. Some form of pulley/screw arrangement 24 is used for mounting the separator roller 18 about a support shaft 18A in such a manner that manipulating the pulley adjusts the amount of force with which the separator roller 18 bears down into contact with the drum rollers 12. The separator roller 18 is maintained stationary or, more preferably, has an associated clutch mechanism which allows restricted rotation against the direction of bill flow but restricts any rotation in the counter direction.

As described above, the picker roller 14 is maintained in free pivoting contact with the pressure roller 16 (preferably, under the gravitational influence of the weight of the picker roller mounting arrangement) when the machine runs idly without any bills. Even in this position, the picker roller 14 is preferably disposed in such a way that its external periphery overlaps the periphery of the drum roller 12. However, a corresponding groove or release (not shown) is provided on the external surface of the drum roller 12 so that the picker roller 14 may ride within the groove freely into and out of contact with the pressure roller 16.

The operation of the arrangement described above in connection with FIG. 5 is similar to that described above in connection with FIGS. 3 & 4. Essentially, the feed and drum rollers 11 and 12, respectively, operate in conjunction to "jog" the bottom bill away from a bill stack along the direction of bill flow. The picker rollers 14 are initially maintained in counter-rotating contact with the pressure roller 16 so as to rotate in a direction counter to that of bill flow.

Accordingly, when a small stack of bills comes into contact with the picker rollers 14, the above-noted retard action takes place and the upper bills are effectively kicked back while the bottom bills are successively stripped away from the stack. As the first bottom bill is fed into contact with the picker rollers 14 and the drum rollers 12, the picker rollers are brought out of contact with the pressure roller 16, and effectively maintained in the above-noted neutral position until the final bill has been fed in. This retard/neutral operation of the picker rollers, in combination with the direct contact between their arcuate periphery and the incoming bills, effectively "fans" the bills and ensures efficient stripping away of successive bottom bills.

We claim:

1. In currency handling apparatus wherein an input bin is provided for accepting a stack of bills from which bottom bills are to be successively fed in single file in a given feed direction along a bill transport path, a feed arrangement comprising:

at least one drum roller adapted to frictionally contact said bottom bills to facilitate advancement thereof along the bill feed direction, said drum roller being rotationally driven in a direction which is complementary to said bill feed direction, and at least one picker roller adapted to contact and retard incoming bills other than said bottom bills, said picker roller being rotationally driven in a substantially continuous fashion in a direction counter to said bill feed direction as said roller contacts said incoming currency bills and in the absence of a bill in the region of engagement between said picker roller and said drum roller so as to impose a retarding action upon bills coming into contact therewith, thereby restricting said bills other than said bottom bills from being fed in along with said bottom bills, said picker roll being subsequently susceptible to rotation along said bill feed direction by contact with bills between said picker and drum rollers.

2. The feed arrangement according to claim 1 wherein a pressure roller is provided downstream of said drum roller along said bill transport path, said roller being rotationally driven along said bill feed direction by direct counter-rotating contact with said drum roller, and said picker roller is subjected to said rotation counter to said bill feed direction by direct counter-rotating contact with said pressure roller.

3. The feed arrangement according to claim 2 wherein said picker roller is capable of pivotal motion toward and away from said counter-rotating contact with said pressure roller, and wherein said roller, when in contact with said pressure roller, is disposed in an overlapping yet unobstructed peripheral relationship with said drum roller, whereby the presence of a bill in between said picker and pressure rollers pivots said picker roller into said neutral contact away from said counter-rotating contact with said pressure roller.

4. The feed arrangement according to claim 3 wherein said picker roller has a smooth, low-friction external surface.

5. The feed arrangement according to claim 3 wherein said picker roller has a high-friction external surface for increased retarding of said incoming bills.

6. The feed arrangement according to claim 3 wherein the external surface of said drum roller is provided with at least one selectively disposed eccentric surface adapted to establish intermittent contact between said picker and drum rollers, whereby the rotation of said picker roller is selectively alternated between (i) counter-rotating contact with said pressure roller in a direction counter to said bill flow direction, and (ii) counter-rotating contact with said drum roller along said bill flow direction.

7. In a feed arrangement for currency handling apparatus, wherein the feed arrangement includes a drum roller rotationally driven in a first direction for frictionally contacting successive bottom bills from a stack of bills that are to be advanced in single file along a given feed direction, a picker roller adapted to bear down into contact with leading edges of said bills being advanced by said drum roller so as to facilitate advancement of only said bottom bills along said feed direction, and a pressure roller disposed downstream of said picker roller for guiding said advanced bottom bills further along said feed direction, said pressure roller being mounted in direct counter-rotating contact with said drum roller along said bill feed direction, the improvement comprising:

mounting said picker roller for direct counter-rotating contact with said pressure roller along a direction counter to said bill feed direction so as to impart a retarding action upon said stacked bills coming into contact therewith, said contact between said picker and pressure rollers being broken in the presence of a bill between said picker and drum rollers, whereby said picker roller is subsequently susceptible to rotation along said bill feed direction by contact with said bill between said picker and drum rollers.

8. The feed arrangement according to claim 7 wherein said picker roller is capable of pivotal motion toward and away from said counter-rotating contact with said pressure roller, and said roller, when in contact with said pressure roller, is disposed in an overlapping yet unobstructed peripheral relationship with said drum roller, whereby the presence of a bill in between said picker and pressure rollers pivots said picker roller into said neutral contact away from said counter-rotating contact with said pressure roller.

9. The feed arrangement according to claim 8 wherein said picker roller has a smooth, low-friction external surface.

10. The feed arrangement according to claim 8 wherein said picker roller has a high-friction external surface for increased retarding of said incoming bills.

11. The feed arrangement according to claim 8 wherein the external surface of said drum roller is provided with at least one selectively disposed eccentric surface adapted to establish intermittent contact between said picker and drum rollers, whereby the rotation of said picker roller is selectively alternated between (i) counter-rotating contact with said pressure roller in a direction counter to said bill flow direction, and (ii) counter-rotating contact with said drum roller along said bill flow direction.

* * * * *